US010180044B2

(12) United States Patent
Vasques et al.

(10) Patent No.: US 10,180,044 B2
(45) Date of Patent: Jan. 15, 2019

(54) DOWNHOLE WIRELESS TRANSFER SYSTEM

(71) Applicant: WELLTEC A/S, Allerød (DK)

(72) Inventors: Ricardo Reves Vasques, Allerød (DK); Dean Richard Massey, Allerød (DK)

(73) Assignee: Welltec A/S, Allerød (DK)

( * ) Notice: Subject to any disclaimer, the term of this patent is extended or adjusted under 35 U.S.C. 154(b) by 0 days.

(21) Appl. No.: 15/504,114

(22) PCT Filed: Aug. 26, 2015

(86) PCT No.: PCT/EP2015/069525

§ 371 (c)(1),
(2) Date: Feb. 15, 2017

(87) PCT Pub. No.: WO2016/030412

PCT Pub. Date: Mar. 3, 2016

(65) Prior Publication Data

US 2017/0254183 A1 Sep. 7, 2017

(30) Foreign Application Priority Data

Aug. 27, 2014 (EP) ..... 14182419

(51) Int. Cl.
*E21B 47/14* (2006.01)
*E21B 47/16* (2006.01)
(Continued)

(52) U.S. Cl.
CPC ..... *E21B 41/0085* (2013.01); *E21B 47/01* (2013.01); *E21B 47/12* (2013.01); *E21B 47/14* (2013.01); *E21B 47/16* (2013.01)

(58) Field of Classification Search
None
See application file for complete search history.

(56) References Cited

U.S. PATENT DOCUMENTS 4,106,565 A * 8/1978 Braddick ..... E21B 23/06 166/118
4,343,356 A * 8/1982 Riggs ..... E21B 36/04 166/248

(Continued)

FOREIGN PATENT DOCUMENTS

EP 0 773 345 5/1997
EP 2 565 368 3/2013

(Continued)

OTHER PUBLICATIONS

International Search Report for PCT/EP2015/069525 dated Nov. 26, 2015, 5 pages.

(Continued)

*Primary Examiner* — Chico A Foxx
(74) *Attorney, Agent, or Firm* — Nixon & Vanderhye P.C.

(57) ABSTRACT

The present invention relates to a downhole wireless transfer system (1) for transferring signals and/or power, comprising a production casing (2) arranged in a borehole (3), defining an annulus (4) therebetween, the production casing having an inner face (5) and an outer face (6), a downhole tool (7) comprising a first ultrasonic transceiver (8), a second ultrasonic transceiver (9) connected to the outer face of the production casing, wherein the tool comprises a projectable means (10) configured to bring the first ultrasonic transceiver in contact with the inner face of the production casing, so that signals and/or power can be transferred through the production casing via ultrasonic waves between the first and second ultrasonic transceivers. The present invention also relates to a method for wirelessly transferring signals and/or power in a downhole wireless transfer system according to the present invention.

19 Claims, 10 Drawing Sheets

(51) Int. Cl.

| | |
|---|---|
| ***E21B 41/00*** | (2006.01) |
| ***E21B 47/12*** | (2012.01) |
| ***E21B 47/01*** | (2012.01) |

(56) References Cited

U.S. PATENT DOCUMENTS

| | | | | |
|---|---|---|---|---|
| 4,665,511 | A * | 5/1987 | Rodney | E21B 47/082 367/27 |
| 5,914,911 | A * | 6/1999 | Babour | E21B 47/121 340/853.7 |
| 6,151,554 | A * | 11/2000 | Rodney | G01V 1/42 702/17 |
| 6,343,649 | B1 * | 2/2002 | Beck | E21B 31/18 166/250.01 |
| 6,470,996 | B1 * | 10/2002 | Kyle | G01V 1/46 181/103 |
| 6,880,402 | B1 * | 4/2005 | Couet | B08B 3/12 73/1.49 |
| 7,595,737 | B2 * | 9/2009 | Fink | E21B 47/16 175/40 |
| 8,605,548 | B2 * | 12/2013 | Froelich | E21B 47/16 340/854.4 |
| 9,477,008 | B2 * | 10/2016 | Robbins | G01V 11/002 |
| 9,500,074 | B2 * | 11/2016 | Tips | E21B 47/16 |
| 2002/0084913 | A1 * | 7/2002 | Hudson | E21B 47/121 340/853.1 |
| 2004/0246141 | A1 | 12/2004 | Tubel et al. | |
| 2005/0269078 | A1 * | 12/2005 | Morgenthaler | B08B 3/12 166/249 |
| 2006/0001549 | A1 * | 1/2006 | Shah | G01V 11/002 340/854.4 |
| 2011/0205841 | A1 * | 8/2011 | DiFoggio | G01V 1/181 367/35 |
| 2014/0202242 | A1 * | 7/2014 | Hallundbæk | E21B 4/18 73/152.58 |
| 2014/0326506 | A1 * | 11/2014 | DiFoggio | G01H 15/00 175/39 |
| 2015/0034305 | A1 * | 2/2015 | Tips | E21B 47/12 166/250.01 |

FOREIGN PATENT DOCUMENTS

| | | |
|---|---|---|
| WO | WO 03/067029 | 8/2003 |
| WO | WO 2008/105947 | 9/2008 |
| WO | WO 2014/100262 | 6/2014 |

OTHER PUBLICATIONS

Written Opinion of the ISA for PCT/EP2015/069525 dated Nov. 26, 2015, 8 pages.

Extended Search Report for EP14182419.3 dated Feb. 11, 2015, 8 pages.

* cited by examiner

DOWNHOLE WIRELESS TRANSFER SYSTEM

This application is the U.S. national phase of International Application No. PCT/EP2015/069525 filed Aug. 26, 2015 which designated the U.S. and claims priority to EP Patent Application No. 14182419.3 filed Aug. 27, 2014, the entire contents of each of which are hereby incorporated by reference.

FIELD OF THE INVENTION

The present invention relates to a downhole wireless transfer system for transferring signals and/or power and to a method for wirelessly transferring signals and/or power in such downhole wireless transfer system.

BACKGROUND ART

Wireless communication and battery recharge are fields within the oil industry which have become of particular importance, since the wells have become more intelligent and thus more reliant on electronics in that they are equipped with sensors etc.

Many attempts to develop communication between surface and downhole components in order to control and adjust the same have been made and this has become a particular focus area in recent years. However, the solution of having electronic control lines through the main barriers has, due to safety requirements, been abandoned. There is therefore a need of other solutions for controlling the completion components downhole.

Other solutions such as radio communication have experienced some challenges due to variations in the fluid inside or outside the production casing, and hence radio communication used for this purpose has not been commercially successful yet.

SUMMARY OF THE INVENTION

It is an object of the present invention to wholly or partly overcome the above disadvantages and drawbacks of the prior art. More specifically, it is an object to provide an improved transfer system without the need of electrical control lines to surface and a transfer system which is more independent of the fluid composition in the well.

The above objects, together with numerous other objects, advantages and features, which will become evident from the below description, are accomplished by a solution in accordance with the present invention by a downhole wireless transfer system for transferring signals and/or power, comprising:

- a production casing/well tubular structure arranged in a borehole, defining an annulus therebetween, the production casing having an inner face and an outer face,
- a downhole tool comprising a first ultrasonic transceiver, and
- a second ultrasonic transceiver connected to the outer face of the production casing, wherein the tool comprises a projectable means configured to bring the first ultrasonic transceiver in contact with the inner face of the production casing, so that signals and/or power can be transferred through the production casing via ultrasonic waves between the first and second ultrasonic transceivers.

The ultrasonic waves may have a frequency of 100 kHz-500 kHz, preferably between 125-400 kHz, more preferably between 150-400 MHz.

Moreover, the production casing may have a resonance frequency, and the first and second ultrasonic transceivers may transmit and/or receive signals at a frequency which is substantially equal to the resonance frequency.

When having a transceiver on the outside of a production casing, the transceiver is installed together with the production casing when completing the well, and power to the transceiver is therefore limited to a battery, which loses its power very quickly, or power transmitted from within the casing to the transceiver on the outside of the production casing, which is also very limited. Therefore, the power consumption of the second ultrasonic transceiver connected to the outer face of the production casing or well tubular structure is very critical for the operation of the downhole wireless transfer system. By transmitting signals at a frequency which is substantially equal to the resonance frequency of the production casing, signals are transferred even though the power consumption is minimal, and thus the battery can last longer.

Further, the second ultrasonic transceiver may transmit signals at different frequencies.

By transmitting at different frequencies, the signals of the second ultrasonic transceiver can be received more clearly or easily due to the fact that the background noise can be filtered out from the signals having different frequencies.

Also, the first and second ultrasonic transceivers may transmit and/or receive signals at a frequency of 100 kHz-500 kHz, preferably between 125-400 kHz, more preferably between 150-400 MHz.

In addition, the first second ultrasonic transceiver and/or the second ultrasonic transceiver may transmit and/or receive signals at a data rate which is configured to 50-500 bits per second.

Thus, both the first and the second ultrasonic transceivers may abut the casing, in that the first and the second ultrasonic transceivers contact the production casing. The first and the second ultrasonic transceivers can thereby transfer power or signals through the metal material, and the problems of transferring power or signal through different materials, such as metal and fluid, are eliminated, and the transfer is thus more precise and the charging more powerful and fast. In known systems, lots of power and signal is lost in the transition between metal and fluid comprised in the casing or surrounding the casing.

The production casing may be a metal tubular structure.

Moreover, the ultrasonic waves may have a frequency of 20 kHz-15 MHz, preferably between 3-12 MHz, more preferably between 6-10 MHz.

Furthermore, the ultrasonic waves may have a frequency of 20 kHz-15 MHz, preferably between 40-750 kHz, more preferably between 40-500 MHz.

Also, the downhole tool may comprise another first ultrasonic transceiver, the first transceivers being arranged having a distance between them along an axial extension of the downhole tool.

By having two first ultrasonic transceivers in the downhole tool, the background noise in the signals from the second ultrasonic transceiver can be received more easily, since the background noise can be filtered out.

The downhole tool may comprise another first ultrasonic transceiver, the first transceivers being arranged having a distance between them along a radial extension of the downhole tool.

Further, the downhole tool may comprise a plurality of first ultrasonic transceivers.

In addition, the downhole wireless transfer system may comprise a plurality of second ultrasonic transceivers connected to the outer face of the production casing.

Moreover, the production casing may have an impedance, and the first and second ultrasonic transceivers may each have an impedance substantially matching the impedance of the production casing in order to maximise power transfer and/or minimise signal reflection.

Also, the first ultrasonic transceiver may be arranged in the projectable means.

Said projectable means may be an arm.

Furthermore, the tool may have a tool body, the first ultrasonic transceiver being arranged in the tool body.

The first and/or the second ultrasonic transceiver(s) may be a transducer.

Moreover, the first and/or the second ultrasonic transceiver(s) may be a piezo-electric transducer.

In addition, the first and/or the second ultrasonic transceiver(s) may comprise a piezo-electric element.

Additionally, the tool may comprise a first tool part and a second tool part, the first ultrasonic transceiver may be arranged in the first tool part and the second tool part may comprise a unit for aligning the first ultrasonic transceiver with the second ultrasonic transceiver by rotating or axially displacing the first ultrasonic transceiver in relation to the second ultrasonic transceiver in order to minimise a transfer distance between the first ultrasonic transceiver and the second ultrasonic transceiver.

Further, the unit may be an electric motor, an actuator or the like.

Moreover, the second ultrasonic transceiver may be connected with a power supply, such as a battery, an electrical motor, a sensor and/or a processor.

The sensor may be a flow rate sensor, a pressure sensor, a capacitance sensor, a resistivity sensor, an acoustic sensor, a temperature sensor or a strain gauge.

Also, the first and second ultrasonic transceivers may be in direct contact with the production casing during the transfer of signals and/or power.

Furthermore, the tool may comprise a positioning means.

In addition, the tool may comprise a power supply.

Further, the tool may comprise a communication unit.

Moreover, the tool may be connected to a wireline or coiled tubing.

The downhole wireless transfer system as described above may further comprise an annular barrier isolating a first part of the annulus from a second part of the annulus, the annular barrier comprising:

- a tubular part adapted to be mounted as part of the production casing, the tubular part having an outer face,
- an expandable metal sleeve surrounding the tubular part and having an inner sleeve face facing the tubular part and an outer sleeve face facing a wall of a borehole, each end of the expandable sleeve being connected with the tubular part, and
- an annular space between the inner sleeve face of the expandable sleeve and the tubular part.

Also, the second ultrasonic transceiver may be comprised in the annular barrier or may be arranged in connection with the annular barrier.

Additionally, the system may comprise a plurality of annular barriers.

Furthermore, when the projectable means brings the first ultrasonic transceiver closer to the inner face of the production casing, there may be a space between the first ultrasonic transceiver and the inner face of the production casing.

The downhole wireless transfer system as described above may further comprise an inflow valve assembly for controlling an inflow of well fluid into the production casing, the second ultrasonic transceiver being arranged in connection with the inflow valve assembly.

The present invention also relates to a method for wirelessly transferring signals and/or power in a downhole wireless transfer system according to the present invention, comprising the steps of:

- positioning the first ultrasonic transceiver in relation to the second ultrasonic transceiver,
- activating the projectable means of the tool in order to bring the first ultrasonic transceiver in contact with the inner face of the production casing, and
- transferring signals and/or power by means of ultrasonic waves between the first ultrasonic transceiver and the second ultrasonic transceiver through the production casing.

Said method may further comprise the step of aligning the first ultrasonic transceiver in relation to the second ultrasonic transceiver by rotating and/or axially displacing the first ultrasonic transceiver in order to minimise a transfer distance between the first ultrasonic transceiver and the second ultrasonic transceiver.

Also, the method as described above may further comprise the step of transferring power to the second ultrasonic transceiver in order to be able to receive signals from the second ultrasonic transceivers.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
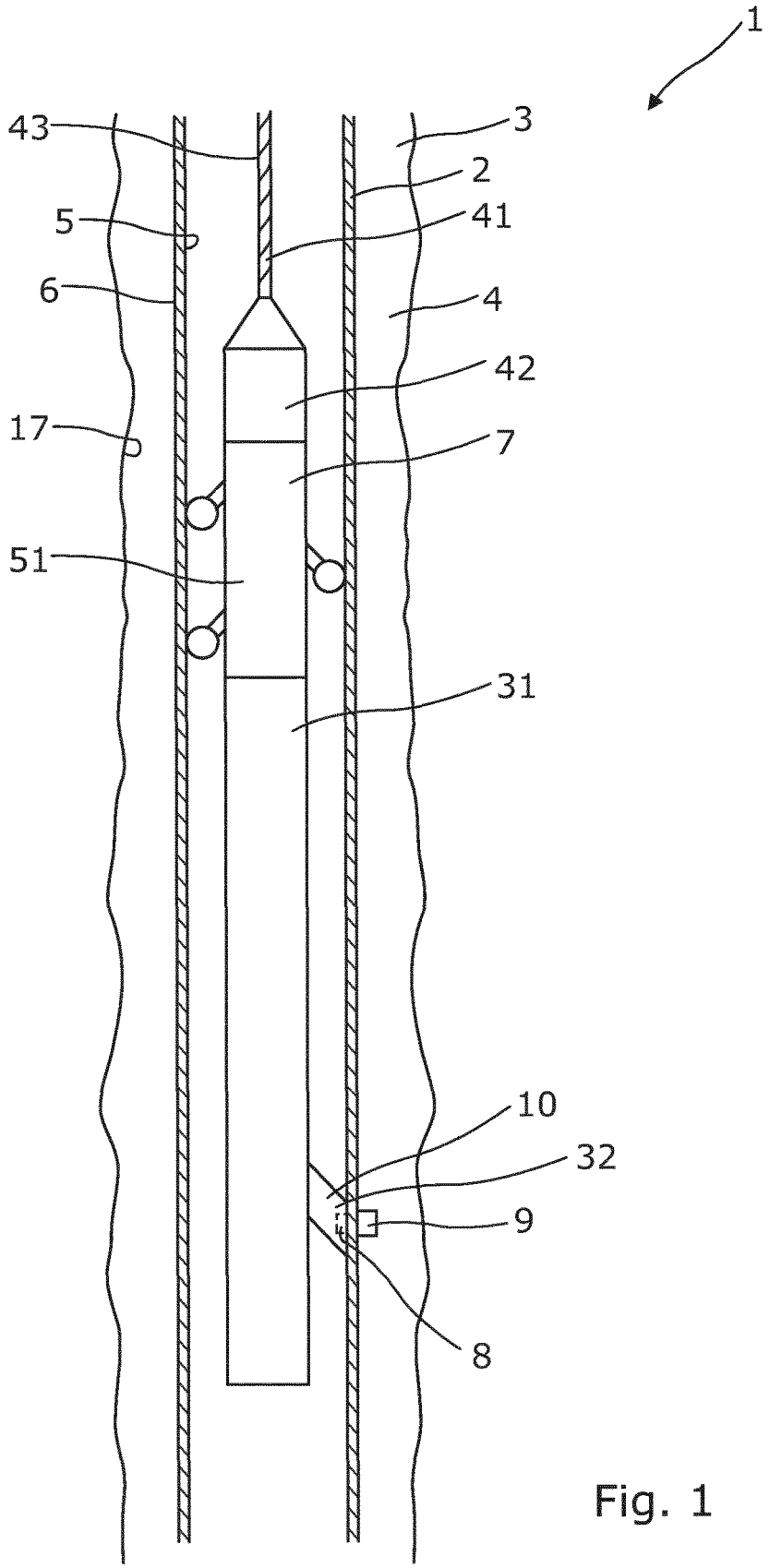
FIG. 1 shows a partly cross-sectional view of a downhole wireless transfer system.

FIG. 1 shows a downhole wireless transfer system 1 for transferring signals and/or power through a production casing 2 which is a metal production casing in an oil well. The production casing 2 is arranged in a borehole 3, thereby defining an annulus 4 between an outer face 6 of the production casing 2 and an inner face 17 of the borehole. The downhole wireless transfer system further comprises a downhole tool 7 comprising a first ultrasonic transceiver 8. A second ultrasonic transceiver 9 is connected to the outer face of the production casing, and the tool comprises a projectable means 10 for bringing the first ultrasonic transceiver in contact with an inner face 5 of the production casing, so that signals and/or power can be transferred through the production casing via ultrasonic waves between the first and second ultrasonic transceivers, propagating in the production casing and not relying on propagation in the fluid in the production casing.

In this way, both the first and the second ultrasonic sensors abut the metal casing from either side, in that the first ultrasonic transceiver contacts the inner face of the production casing and the second ultrasonic transceiver contacts the outer face of the production casing. The first and the second ultrasonic transceivers can thereby transfer power or signals through the metal material, and the problems of transferring power or signal through different materials, such as metal and fluid, are eliminated, and the transfer is thus more precise and the charging more powerful and fast. In known systems, lots of power and signal is lost in the transition between metal and fluid comprised in the casing or surrounding the casing.

In FIG. 1, the first ultrasonic transceiver is arranged in a projectable means 10. The projectable means 10 is an arm 32 which is projectable and retractable from a tool body 31 of the tool, so that the first ultrasonic transceiver contacts the inner face of the production casing 2. The projectable means is pressed into contact with the inner face of the production casing by means of a spring or by means of hydraulics, such as a hydraulic cylinder.

Figure 2:
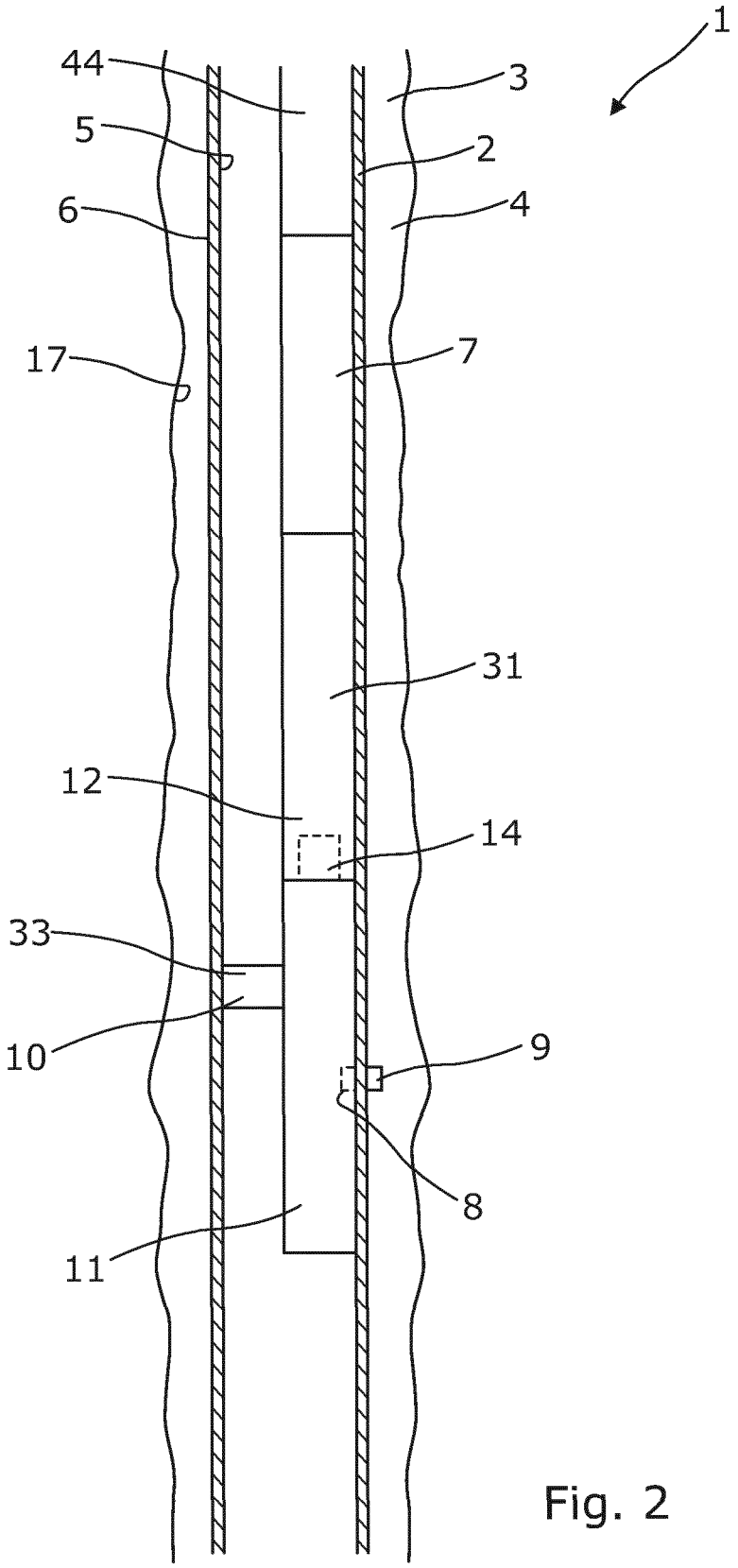
FIG. 2 shows a partly cross-sectional view of another downhole wireless transfer system.

In FIG. 2, the tool has a tool body 31 in which the first ultrasonic transceiver is arranged. The projectable means 10 is a support 33 projecting from the tool body to press against the inner face of the production casing, and the support thereby presses the tool body in the opposite direction and the first ultrasonic transceiver towards the inner face of the production casing as shown. The projectable means 10 projects radially from the tool body 31 by means of a spring or by means of hydraulics, such as a hydraulic cylinder. The projectable means may be a wheel arm of a driving unit for propelling the downhole tool forward in the well.

Figure 3:
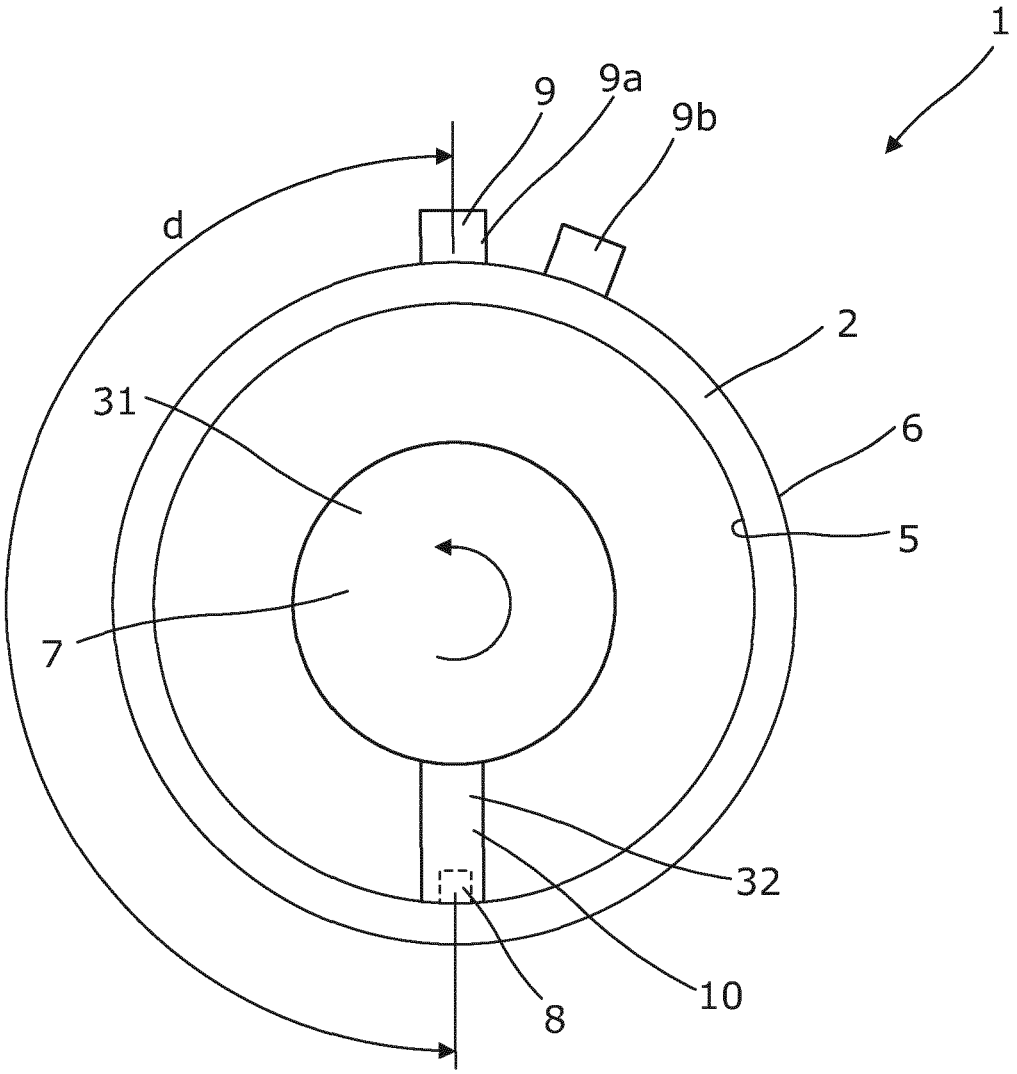
FIG. 3 shows a partly cross-sectional view of the system in which the tool is seen from one end in a first position, in which the first ultrasonic transceiver is furthest away from the second ultrasonic transceiver along the circumference of the structure.
Figure 4:
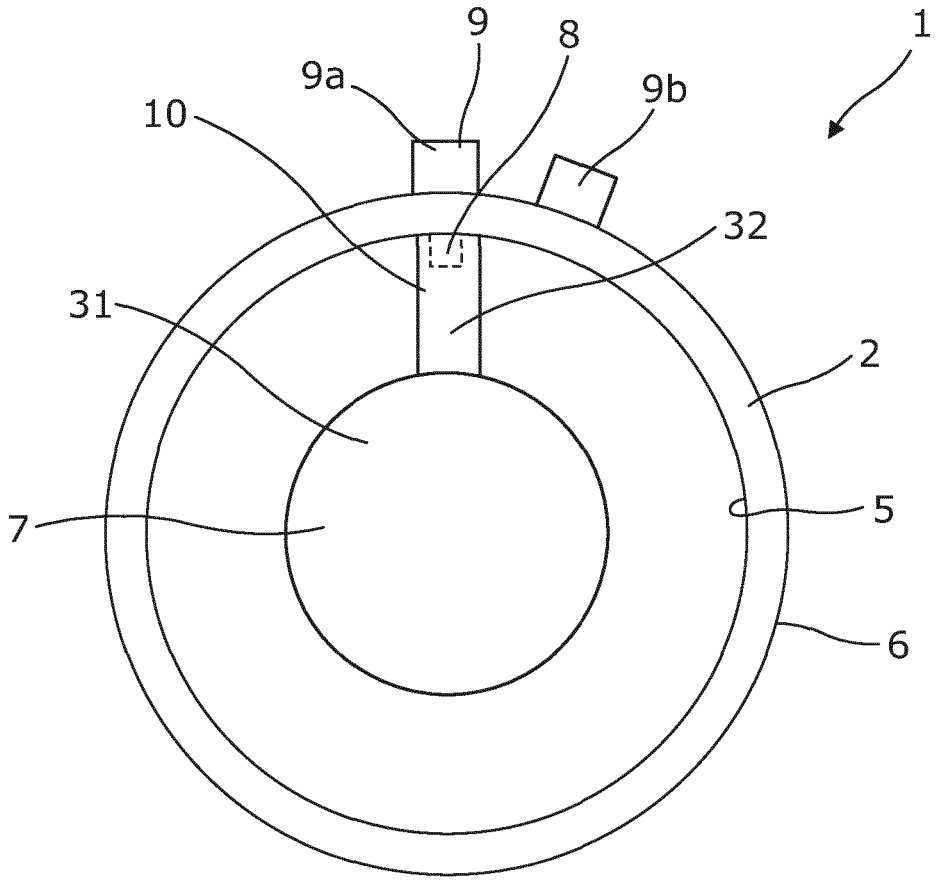
FIG. 4 shows the tool of FIG. 3 in a second position, in which the ultrasonic transceivers are aligned.
Figure 5:
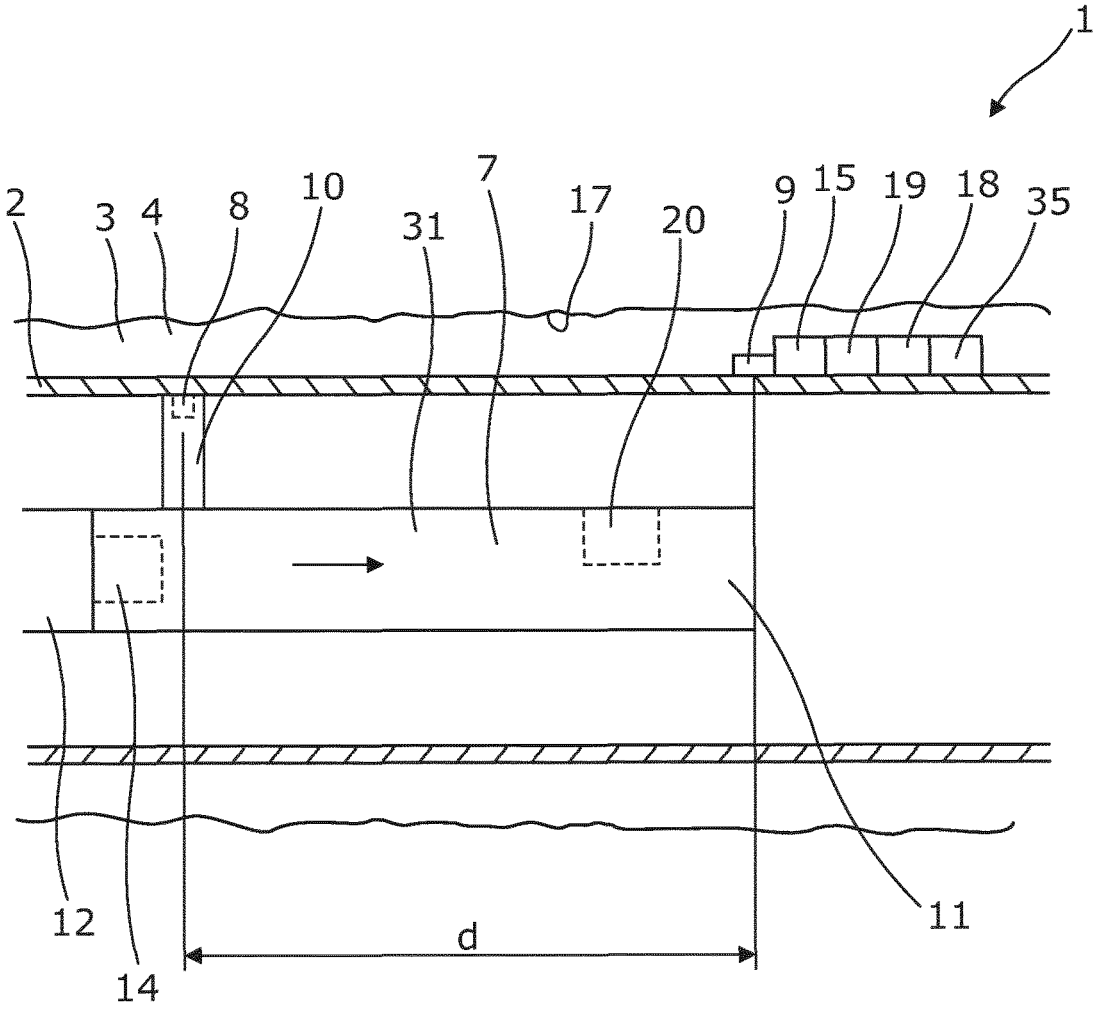
FIG. 5 shows the tool from the side along and in the production casing.

As shown in FIG. 2, the tool comprises a first tool part 11 and a second tool part 12, the first ultrasonic transceiver being arranged in the first tool part, and the second tool part comprises a unit 14 for aligning the first ultrasonic transceiver with the second ultrasonic transceiver. When being 10 km under ground, it may be difficult to position an ultrasonic transceiver inside the production casing with another ultrasonic transceiver on the outside of the production casing. The tool therefore comprises means for aligning the ultrasonic transceivers, e.g. by rotating the first ultrasonic transceiver in relation to the second ultrasonic transceiver in order to minimise a transfer distance d between the first ultrasonic transceiver and the second ultrasonic transceiver, as shown in FIGS. 3 and 4. The unit 14 may also axially displace the first ultrasonic transceiver in relation to the second ultrasonic transceiver as shown in FIG. 5, minimising the transfer distance d in the axial direction. The unit may be an electric motor, a linear actuator, such as a stroking device, or similar actuation unit.

When powering or charging an ultrasonic transceiver, minimising the transfer distance d is of importance, since the shorter the transfer distance d, the more efficient the charging process. In order to align the first ultrasonic transceiver with the second ultrasonic transceiver, the second ultrasonic transceiver is first charged with a small amount of power sufficient to emit a signal. The signal is received by the first ultrasonic transceiver which, when moving, is capable of detecting if the signal becomes stronger or weaker and thus move accordingly to align the first and the second ultrasonic transceivers. As shown in FIGS. 3 and 4, two second ultrasonic transceivers 9*a*, 9*b*, 9 may be arranged on the outer face of the structure, which makes the alignment easier.

In FIG. 5, the second ultrasonic transceiver is connected with a power supply 15, such as a battery, a sensor 18 for measuring a condition of the well fluid and a processor 19 for processing the data/signals received from the sensor. The sensor data may be stored in a storage unit 35. The sensor may be a flow rate sensor, a pressure sensor, a capacitance sensor, a resistivity sensor, an acoustic sensor, a temperature sensor, a strain gauge or similar sensor.

In order to position the tool in the vicinity of the second ultrasonic transceiver, the tool 7 comprises a positioning means 20, as shown in FIG. 5. The tool may further comprise a power supply 41 and a communication unit 42, as shown in FIG. 1. The power supply may be a wireline 43 or coiled tubing 44, as shown in FIG. 2.

The production casing has a resonance frequency or resonant frequency depending on the thickness of the casing, temperature etc. And the first and second ultrasonic transceivers are configured to transmit and receive signals at a frequency which is substantially equal to the resonance frequency. When having a transceiver on the outside of a production casing, the transceiver is installed together with the production casing when completing the well, and power to the transceiver is therefore limited to a battery, which loses its power very quickly, or power transmitted from within the casing to the transceiver on the outside of the production casing, which is also very limited. Therefore, the power consumption of the second ultrasonic transceiver connected to the outer face of the production casing or well tubular structure is very critical for the operation of the downhole wireless transfer system. By transmitting signals at a frequency which is substantially equal to the resonance frequency of the production casing, signals can be transferred at very low power consumption, and thus the battery can last longer or the second transceiver is operative receiving only a small amount of power through the casing, e.g. from the tool. The power may also come from vibrations in the casing, such as from the oil production or from perforations, intercepted by the transceiver.

The second ultrasonic transceiver may also transmit signals at different frequencies. By transmitting at different frequencies, the signals of the second ultrasonic transceiver can be received more clearly or easily due to the fact that the background noise can be filtered out from the signals having different frequencies.

The ultrasonic transceivers transfer power and/or signal between each other by means of ultrasonic waves. The ultrasonic waves have a frequency of 100 kHz-500 kHz, preferably between 125-400 kHz, more preferably between 150-400 MHz. The production casing has an impedance and the first and second ultrasonic transceivers each have an impedance substantially matching the impedance of the production casing in order to maximise power transfer and/or minimise signal reflection. Thus, the ultrasonic transceivers are impedance-matched to metal material.

Figure 6:
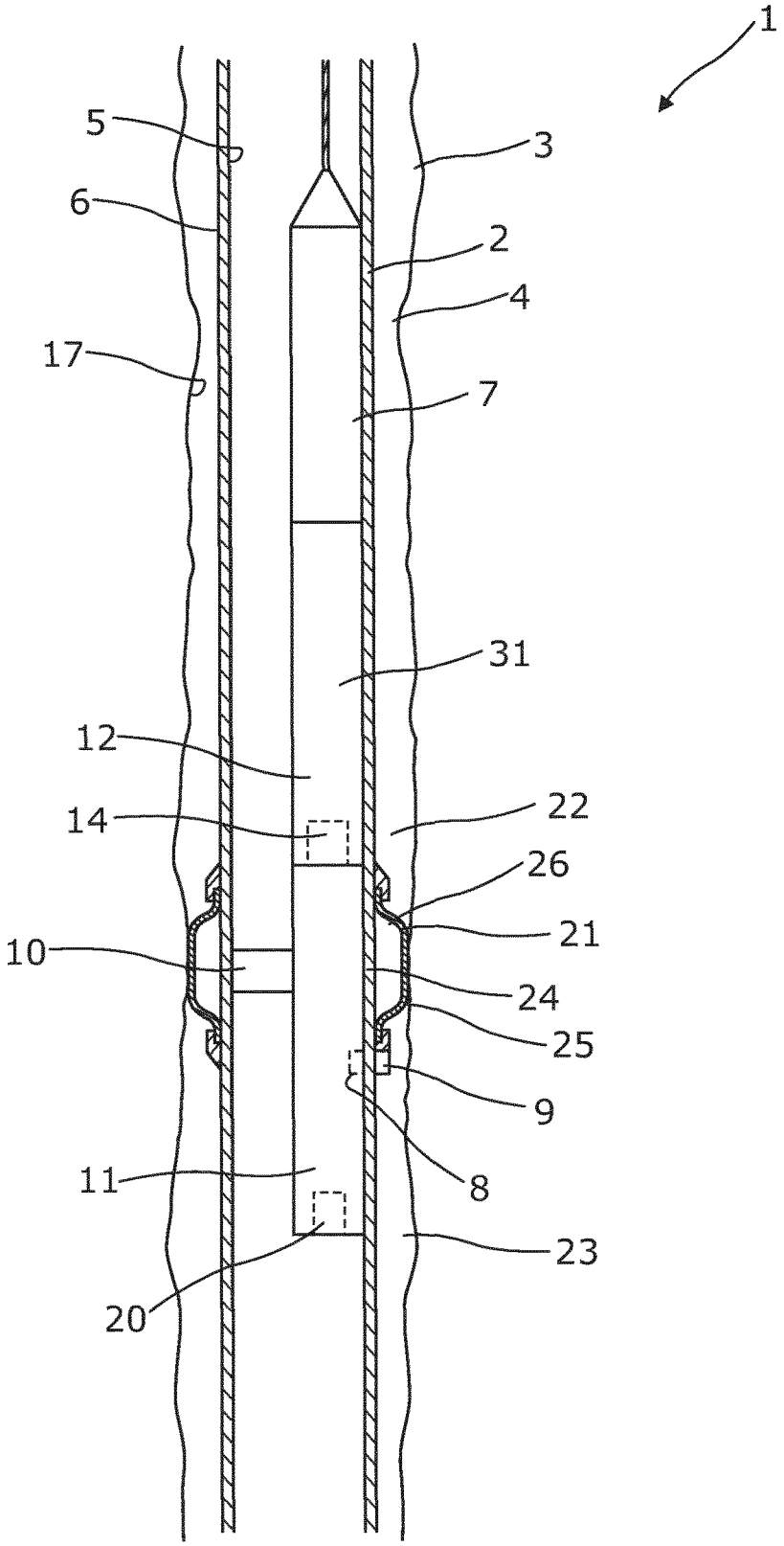
FIG. 6 shows a partly cross-sectional view of another downhole wireless transfer system having an annular barrier.

In FIG. 6, the downhole wireless transfer system 1 further comprises an annular barrier 21 isolating a first part 22 of the annulus from a second part 23 of the annulus. The annular barrier comprises a tubular part 24 adapted to be mounted as part of the production casing, and thus the tubular part is also made of metal. The annular barrier further comprises an expandable metal sleeve 25 surrounding the tubular part and having an inner sleeve face facing the tubular part and an outer sleeve face facing a wall of a borehole. Each end of the expandable sleeve is connected with an outer face of the tubular part enclosing an annular space 26 between the inner sleeve face of the expandable sleeve and the tubular part. As shown, the second ultrasonic transceiver is comprised in the annular barrier by being arranged in one of the connection parts connecting the expandable sleeve with the tubular part. The second ultrasonic transceiver may also be arranged in connection with the annular barrier, as an add-on component. Even though not shown, the system may comprise a plurality of annular barriers isolating several zones.

Figure 7:
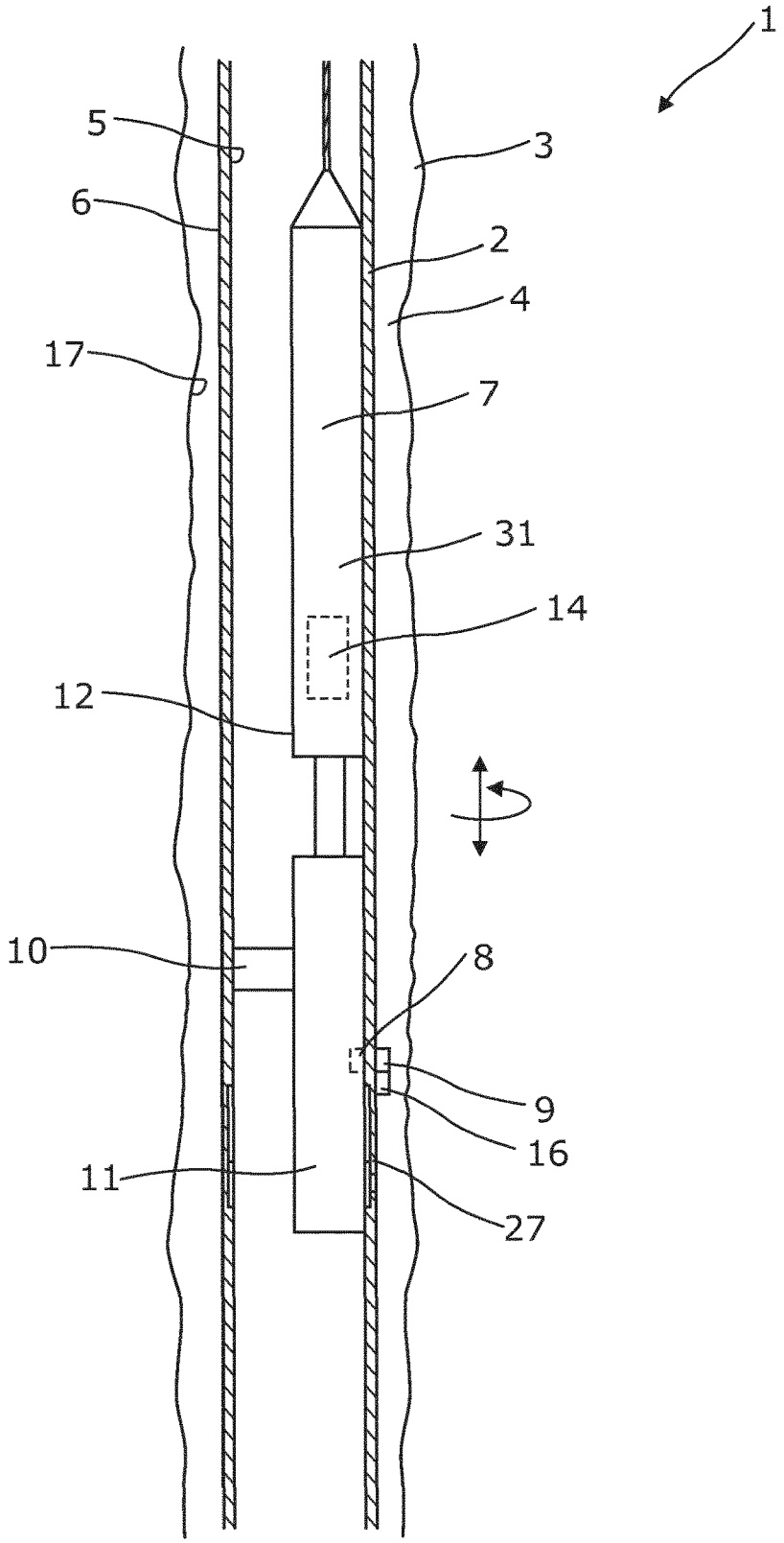
FIG. 7 shows a partly cross-sectional view of another downhole wireless transfer system having a valve assembly and in which the first tool part has been axially displaced in relation to the second tool part.

In FIG. 7, the downhole wireless transfer system 1 comprises an inflow valve assembly 27 for controlling an inflow of well fluid into the production casing. The second ultrasonic transceiver is arranged in connection with the inflow valve assembly for controlling the position of the valve assembly, thus controlling the amount of fluid allowed to enter past the valve assembly. The second ultrasonic transceiver is arranged in connection with an electrical motor 16, so that the electrical motor adjusts the position of the valve and is powered and/or instructed by signals through the second ultrasonic transceiver. The inflow valve assembly may, in another embodiment, be an outflow assembly such as a fracturing port. As can be seen, the unit 14 has moved the first tool part in the axial direction and rotated the first tool part in relation to the second tool part for aligning the first and second ultrasonic transceivers.

The ultrasonic tranceivers are units capable of both receiving and transmitting power and/or signals. The ultrasonic tranceivers may thus be transducers.

The signals and/or power are wirelessly transferred in the downhole wireless transfer system by first positioning the first ultrasonic transceiver in relation to the second ultrasonic transceiver, then activating the projectable means of the tool for bringing the first ultrasonic transceiver in contact with the inner face of the production casing, and subsequently transferring signals and/or power by means of ultrasonic waves between the first ultrasonic transceiver and the second ultrasonic transceiver through the production casing. Before or after the activation of the projectable means, the first ultrasonic transceiver is aligned in relation to the second ultrasonic transceiver by rotating and/or axially displacing the first ultrasonic transceiver in order to minimise a transfer distance between the first ultrasonic transceiver and the second ultrasonic transceiver. Thus, the first tool part comprising the first ultrasonic receiver is displaced axially and rotated as shown in FIG. 7.

In order to align the first ultrasonic transceiver with the second ultrasonic transceiver, power may be transferred to the second ultrasonic transceiver, waking the second ultrasonic transceiver, in order to be able to transmit signals to the first ultrasonic transceiver, so that the first ultrasonic transceiver can detect if the signals becomes stronger or weaker while moving in order to align the ultrasonic transceivers.

Figure 8:
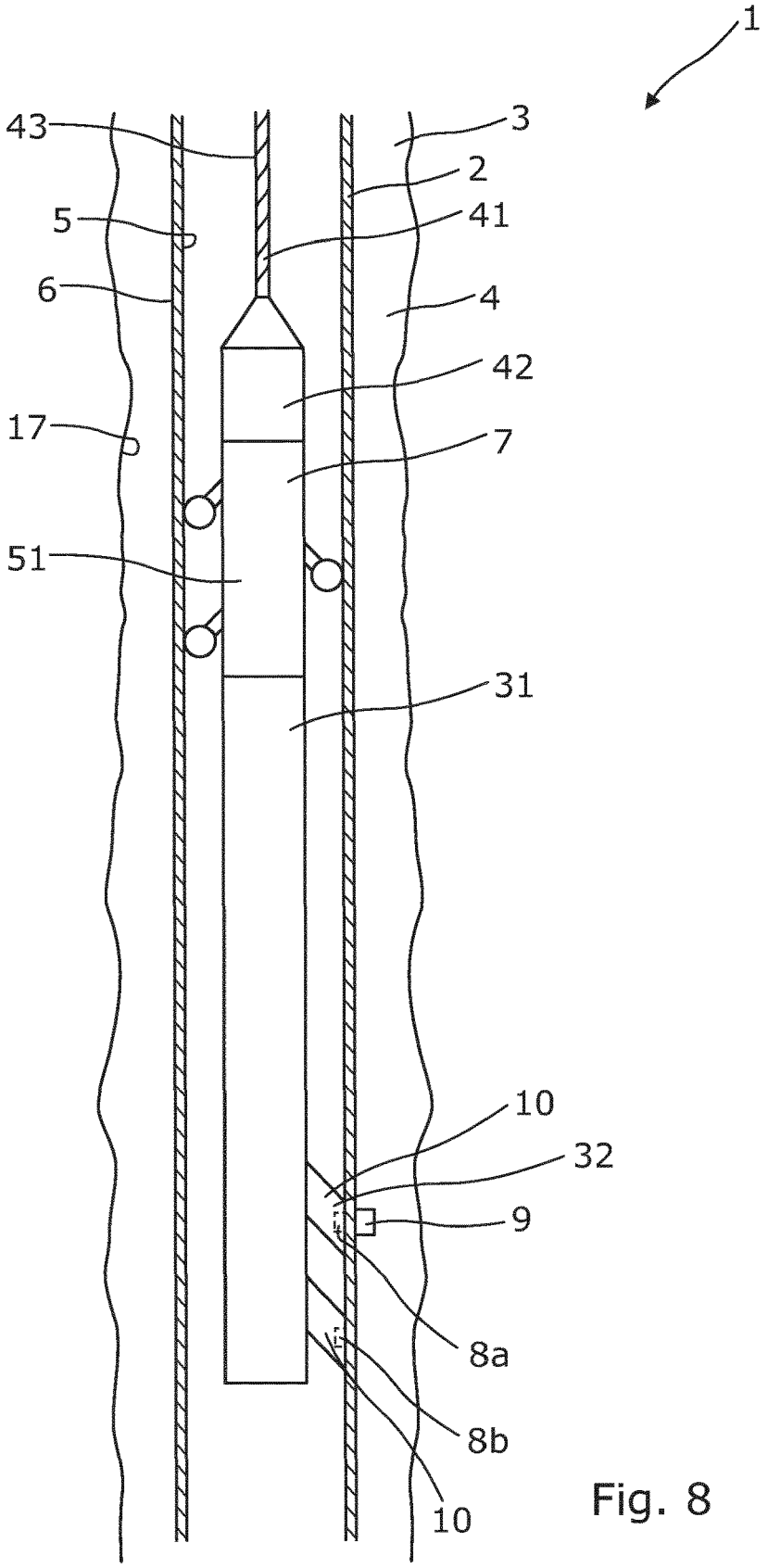
FIG. 8 shows a partly cross-sectional view of another downhole wireless transfer system having two projectable means, each with an ultrasonic transceiver.
Figure 9:
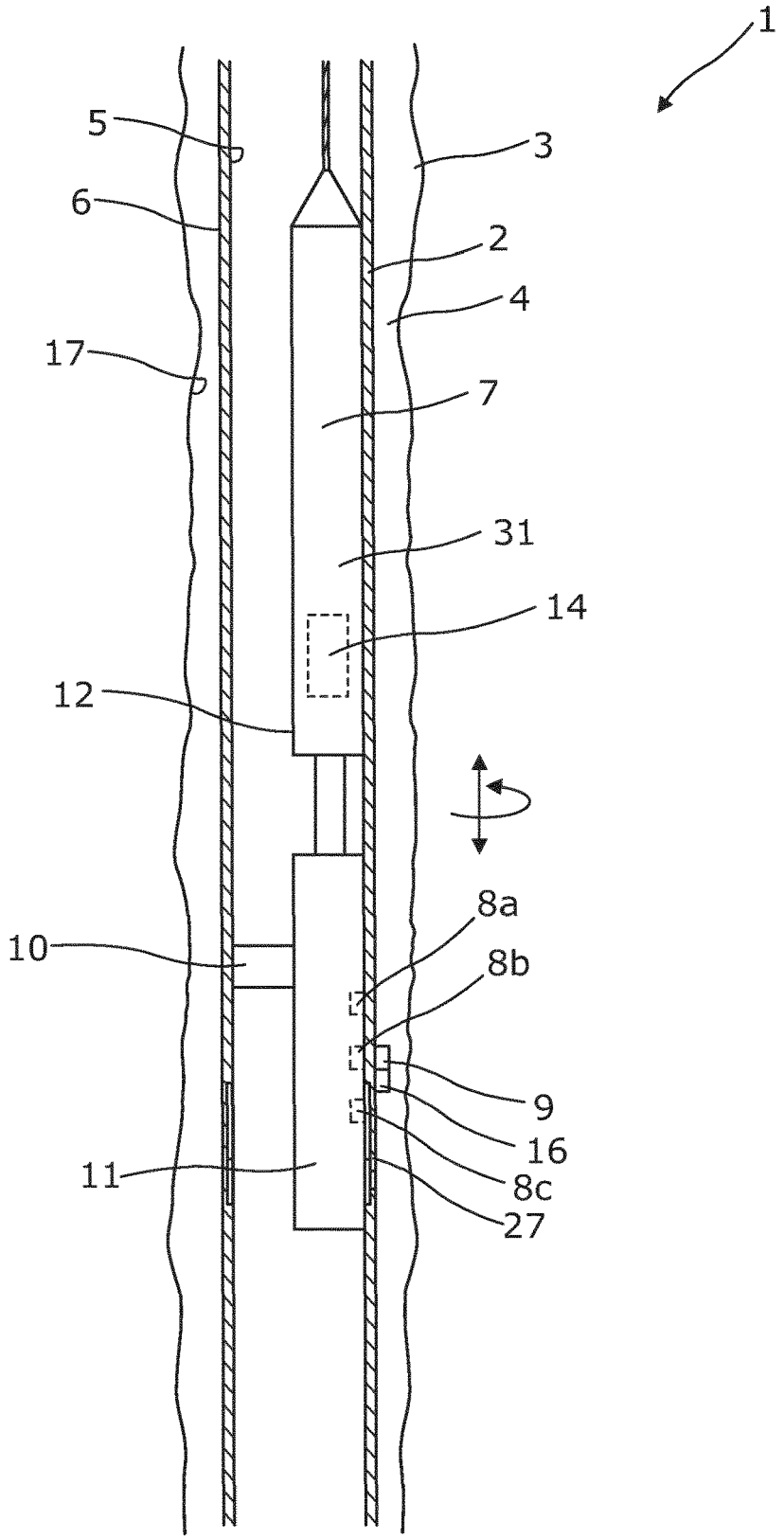
FIG. 9 shows a partly cross-sectional view of another downhole wireless transfer system having two ultrasonic transceivers.

In another aspect, the downhole tool comprises a plurality of first ultrasonic transceivers 8*a*, 8*b* arranged having a distance between them along an axial extension of the downhole tool, as shown in FIG. 8. By arranging several first ultrasonic transceivers at a distance from each other, the background noise in the received signal can be filtered out, and the signal can be received more clearly. In FIG. 9, the downhole tool comprises three first ultrasonic transceivers 8*a*, 8*b*, 8*c* arranged having a distance between them along an axial extension of the downhole tool. As can be seen, when having several first ultrasonic transceivers, the tool does not have to be aligned with the second ultrasonic transceiver on the outside of the production casing, but merely needs to be within a few meters of the second ultrasonic transceiver.

Figure 10:
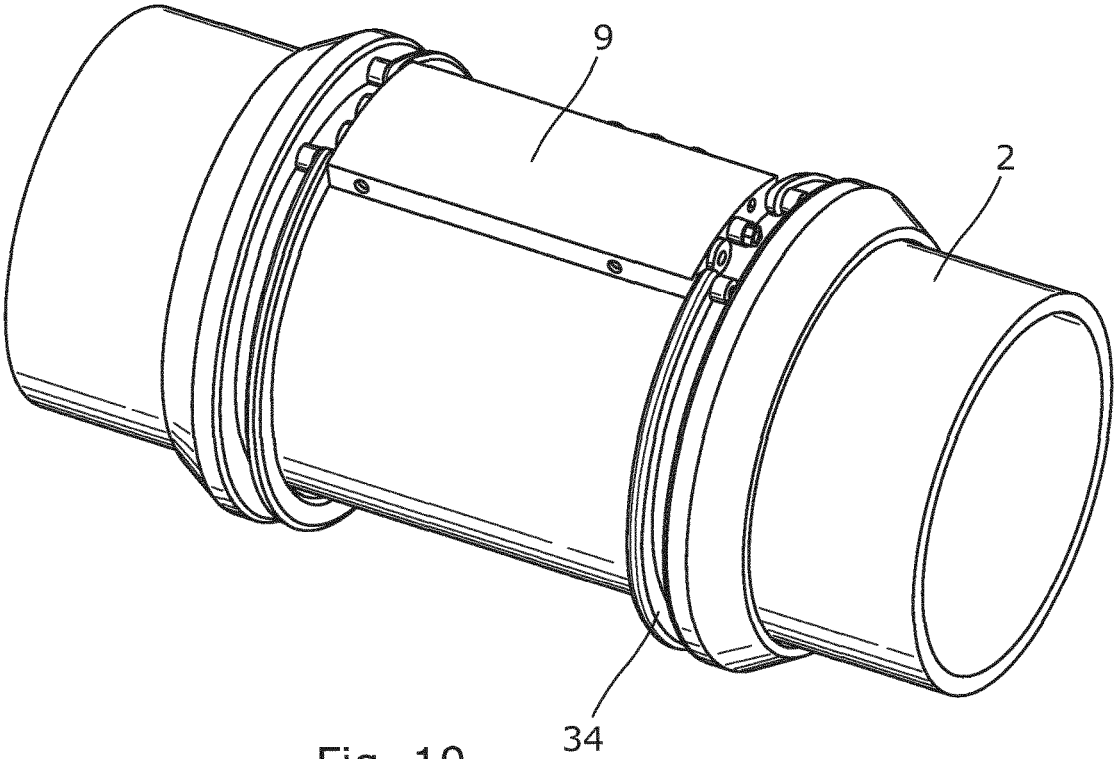
FIG. 10 shows a part of a production casing on which an ultrasonic transceiver is mounted.
Figure 10A:
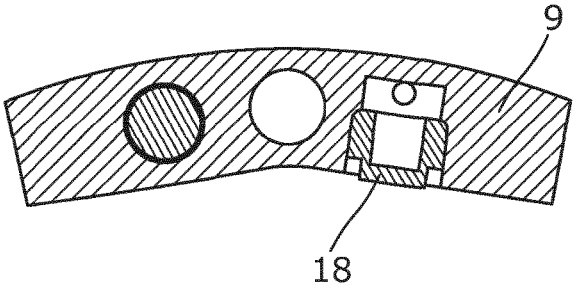
FIG. 10A is a cross-sectional view of the ultrasonic transceiver of FIG. 10.

FIG. 10 discloses part of the production casing on which a second ultrasonic transceiver 9 is arranged by means of circumferential fastening means fastening the sensor of the second ultrasonic transceiver to the outer face of the production casing. In FIG. 10A, the position of the sensor 18 in a cross-sectional view of the second ultrasonic transceiver is shown. The sensor 18 is arranged at the inclined inner face of the second ultrasonic transceiver, so that when the second ultrasonic transceiver is fastened to the outer face, the sensor 18 is brought in direct contact with the outer face of the production casing and thus in metal contact to be able to transmit and receive signals through the production casing and not through the fluid inside the production casing.

A stroking device is a tool providing an axial force. The stroking device comprises an electrical motor for driving a pump. The pump pumps fluid into a piston housing to move a piston acting therein. The piston is arranged on the stroker shaft. The pump may pump fluid into the piston housing on one side and simultaneously suck fluid out on the other side of the piston.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing, production casing or well tubular structure is meant any kind of pipe, tubing, tubular, liner, string etc. used downhole in relation to oil or natural gas production.

In the event that the tool is not submergible all the way into the casing, a downhole tractor 51 can be used to push the tool all the way into position in the well, as shown in FIG. 1. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole wireless transfer system for transferring signals and/or power, comprising:

a production casing arranged in a borehole, defining an annulus therebetween, the production casing having an inner face and an outer face, a downhole tool comprising a first ultrasonic transceiver, and a second ultrasonic transceiver connected to the outer face of the production casing, wherein the first ultrasonic transceiver is configured to move in relation to the second ultrasonic transceiver to align the first ultrasonic transceiver with the second ultrasonic transceiver, and wherein the downhole tool comprises a projectable arm configured and arranged to position the first ultrasonic transceiver to contact the inner face of the production casing, so that signals and/or power can be transferred through the production casing via ultrasonic waves between the first and second ultrasonic transceivers, and wherein the second ultrasonic transceiver is configured to emit a signal, wherein the downhole tool is configured to move in response to signal strength from the second ultrasonic transceiver to align the first ultrasonic transceiver with the second ultrasonic transceiver.

2. The downhole wireless transfer system according to claim 1, wherein the ultrasonic waves have a frequency of 100 kHz to 500 kHz.

3. The downhole wireless transfer system according to claim 1, wherein the production casing has a resonance frequency and the first and second ultrasonic transceivers transmit and/or receive signals at a frequency which is substantially equal to the resonance frequency.

4. The downhole wireless transfer system according to claim 1, wherein the second ultrasonic transceiver transmits signals at different frequencies.

5. The downhole wireless transfer system according to claim 1, wherein the first ultrasonic transceiver and/or the second ultrasonic transceiver transmit(s) and/or receive(s) signals at a data rate which is configured to 50 to 500 bits per second.

6. The downhole wireless transfer system according to claim 1, wherein the downhole tool comprises an other first ultrasonic transceiver, the first ultrasonic transceiver being spaced along an axial extension of the downhole tool from the other first ultrasonic transceiver.

7. The downhole wireless transfer system according to claim 1, wherein the production casing has an impedance, and the first and second ultrasonic transceivers each have an impedance substantially matching the impedance of the production casing in order to increase power transfer and/or reduce signal reflection.

8. The downhole wireless transfer system according to claim 1, wherein the first ultrasonic transceiver is supported by the projectable arm.

9. The downhole wireless transfer system according to claim 1, wherein the downhole tool has a tool body, the first ultrasonic transceiver attached to the tool body.

10. The downhole wireless transfer system according to claim 1, wherein the downhole tool comprises a first tool part and a second tool part, the first ultrasonic transceiver is arranged in the first tool part and the second tool part comprises an actuation unit configured to align the first ultrasonic transceiver with the second ultrasonic transceiver by rotating or axially displacing the first ultrasonic transceiver in relation to the second ultrasonic transceiver in order to reduce a transfer distance between the first ultrasonic transceiver and the second ultrasonic transceiver.

11. The downhole wireless transfer system according to claim 1, wherein the second ultrasonic transceiver is connected with a power supply.

12. The downhole wireless transfer system according to claim 1, wherein the first and second ultrasonic transceivers are in direct contact with the production casing during the transfer of signals and/or power.

13. The downhole wireless transfer system according to claim 1, further comprising an annular barrier isolating a first part of the annulus from a second part of the annulus, the annular barrier comprising:

a tubular part adapted to be mounted as part of the production casing, the tubular part having an outer face, an expandable metal sleeve surrounding the tubular part and having an inner sleeve face facing the tubular part and an outer sleeve face facing a wall of a borehole, each end of the expandable sleeve being connected with the tubular part, and an annular space between the inner sleeve face of the expandable sleeve and the tubular part.

14. The downhole wireless transfer system according to claim 13, wherein the second ultrasonic transceiver is comprised in the annular barrier or is arranged in connection with the annular barrier.

15. The downhole wireless transfer system according to claim 1, further comprising an inflow valve assembly for controlling an inflow of well fluid into the production casing, the second ultrasonic transceiver being arranged in connection with the inflow valve assembly.

16. The downhole wireless transfer system according to claim 1, wherein the first ultrasonic transceiver is adapted to be pressed into contact with the inner face of the production casing.

17. A method for wirelessly transferring signals and/or power in a downhole wireless transfer system comprising:

positioning a first ultrasonic transceiver in a downhole tool, connecting a second ultrasonic transceiver to an outer face of a production casing, displacing the first ultrasonic transceiver to be in contact with an inner face of the production casing, the first ultrasonic transceiver being in the vicinity of the second ultrasonic transceiver, and transferring signals and/or power via ultrasonic waves between the first ultrasonic transceiver and the second ultrasonic transceiver through the production casing, wherein the second ultrasonic transceiver is configured to emit a signal, wherein the downhole tool is configured to move in response to signal strength from the second ultrasonic transceiver to align the first ultrasonic transceiver with the second ultrasonic transceiver.

18. The method according to claim 17, further comprising aligning the first ultrasonic transceiver in relation to the second ultrasonic transceiver by rotating and/or axially displacing the first ultrasonic transceiver in order to reduce a transfer distance between the first ultrasonic transceiver and the second ultrasonic transceiver.

19. The method according to claim 17, further comprising transferring power to the second ultrasonic transceiver in order to be able to receive signals from the second ultrasonic transceivers.

* * * * *